US010812886B2

(12) United States Patent
Berg

(10) Patent No.: US 10,812,886 B2
(45) **Date of Patent: *Oct. 20, 2020**

(54) EARPIECE

(71) Applicant: Freebit AS, Oslo (NO)

(72) Inventor: Richard Steenfeldt Berg, Elisenberg (NO)

(73) Assignee: Freebit AS, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 15/078,796

(22) Filed: Mar. 23, 2016

(65) Prior Publication Data

US 2016/0205456 A1 Jul. 14, 2016

Related U.S. Application Data

(63) Continuation of application No. 14/633,813, filed on Feb. 27, 2015, which is a continuation of application No. 14/109,565, filed on Dec. 17, 2013, now Pat. No. 8,976,995, which is a continuation of application No. 12/600,795, filed as application No. (Continued)

(30) Foreign Application Priority Data

Jun. 1, 2007 (NO) ..... 2007 2812

(51) Int. Cl.
*H04R 1/10* (2006.01)
*H04R 5/033* (2006.01)

(52) U.S. Cl.
CPC ..... *H04R 1/1016* (2013.01); *H04R 1/105* (2013.01); *H04R 1/1091* (2013.01); *H04R 5/033* (2013.01); *H04R 2201/107* (2013.01); *H04R 2225/025* (2013.01)

(58) Field of Classification Search
CPC ..... H04R 1/10; H04R 1/1016; H04R 1/105; H04R 25/65; H04R 25/652; H04R 25/656; H04R 2201/107; H04R 2201/109; H04R 2225/023; H04R 2225/025; H04R 2460/09; H04M 1/05
USPC ..... 381/322, 324, 328, 370, 371, 374, 375, 381/376, 380; 379/430, 431, 420.02, 379/420.03; 181/128, 129, 135; 455/575.1, 575.2
See application file for complete search history.

(56) References Cited

U.S. PATENT DOCUMENTS 6,688,421 B2 * 2/2004 Dyer ..... A61F 11/08 181/130
6,944,307 B2 * 9/2005 Berg ..... H04M 1/6066 181/135
2007/0116309 A1 * 5/2007 Smith ..... H04R 1/1016 381/313

* cited by examiner

*Primary Examiner* — Huyen D Le
(74) *Attorney, Agent, or Firm* — Oblon, McClelland, Maier & Neustadt, L.L.P.

(57) ABSTRACT

An ear unit for stably fitting in an ear includes a first surface facing inwardly toward the ear, a second, opposite surface facing outwardly from the ear and an outer circumferential surface formed between the first and second surfaces. The outer circumferential surface is shaped as a decremental curve. The distance between the ends of the decremental curve is approximately equal to the distance between a first cavity formed under the tragus of the ear and second cavity covered by the lower node of the antihelix of the ear. The first surface is provided with a curvature that provides a contact surface that substantially conforms to the concha, providing an improved attachment, thereby enabling the ear unit to fit closely against the concha when the ear unit is positioned into the ear.

5 Claims, 2 Drawing Sheets

Related U.S. Application Data

PCT/NO2008/000190 on May 30, 2008, now Pat. No. 8,630,436.

EARPIECE

This application is a continuation of U.S. application Ser. No. 14/633,813 filed on Feb. 27, 2015, which is a continuation of U.S. application Ser. No. 14/109,565 filed on Dec. 17, 2013 (now U.S. Pat. No. 8,976,995), which is a continuation of U.S. application Ser. No. 12/600,795 filed on May 7, 2010 (now U.S. Pat. No. 8,630,436), which is the National Phase of International Application No. PCT/NO2008/000190 filed on May 30, 2008, which claims priority under 35 U.S.C. § 119(a) to Norwegian Patent Application No. 20072812 filed on Jun. 1, 2007. The contents of all of these applications are hereby expressly incorporated by reference as fully set forth herein, in their entirety.

BACKGROUND OF THE INVENTION

Field of the Invention

The present invention regards a device for removable attachment to the ear.

Discussion of the Related Art

Microphone/earpiece combinations, wireless or attached by wire, to telephones, music systems, switchboards etc. are well known. Such known devices, however, frequently use a bow for the earpieces and a microphone attached to said bow. Such devices are not well suited for use with mobile apparatuses since the device should have a form that makes it easy to stow it in a pocket, bag or the like when not in use.

From the prior art one should refer to U.S. Pat. Nos. 6,122,388 and 5,659,156. These are earmold devices where a plug is brought into the ear canal and are typically used in hearing devices. These are not suited for mass production since each has to be adapted to each user for the stable positioning and comfortable use. This is particularly due to the opening in the ear that the ear plug is brought into differs from person to person. The outer part of the ear also differs from person to person yet these differences are not so great. Thus, using the outer shape of the ear for attachment of an ear unit only 2 or 3 different sizes will accomplish said differences.

Also an ear plug will block the ear canal and appear uncomfortable to a user. Moreover the natural production of ear wax will not escape, thus necessitating flushing of the ear at regular intervals.

References should also be made to U.S. Pat. No. 5,943,627 regarding an ear piece with built in microphone. Ear pieces for walkmen and the like are known, using the outer part of the ear for attachment, yet these have a circular shape and exploit only the lower part of the outer cavity of an ear for attachment and small differences in the size of the ear will cause said ear pieces not to fit particularly well.

References should also be made to a German utility patent DE 29718483 U1 where an inner clamp forces hoops outwardly towards the inner parts of the ear cavity in order to secure an attachment. The disadvantage is the constant outward pressure being exerted which over time can lead to discomfort.

Further references should be made to WO 02/45390, related to Norwegian patent NO 312 989 belonging to the applicant where a comfortable attachment is achieved by a combination of an ear unit formed as a large C placed under the tragus of the ear while further stability is assured by one part extending from the ear unit in the intertragic notch.

Also a reference should be made to WO 01/50813, an ear mould, filling in a substantial part of the ear mussel and the intertragic notch.

Next a reference should be made to WO 2004/100508, an ear unit using pads, where one of the support pads of is positioned between the Tragus and the Antitragus.

Finally, references should also be made to the Norwegian patent NO 312 909.

Also a reference should be made to US 2005/0008180 regarding a generally symmetric earpiece for use in either ear and made from a resilient material.

OBJECTIVE OF THE INVENTION

Based on the prior art the object of the invention is to avoid these disadvantages and limitation and simultaneously provide a further improvement in stability and comfortable attachment of an ear unit with the possibility of further functionality.

SUMMARY OF THE INVENTION

This is provided by a device according to the present invention. Further features of the invention are disclosed by the remaining dependent claims.

The shape of the ear unit keeps the ear canal to a certain degree open towards the outer environment for improved comfort when compared to a unit that closes or blocks the ear canal.

BRIEF DESCRIPTION OF THE DRAWINGS

Where is embodiments of the invention will be disclosed with references to the drawings, where.

DETAIL DESCRIPTION OF THE INVENTION

Figure 1:
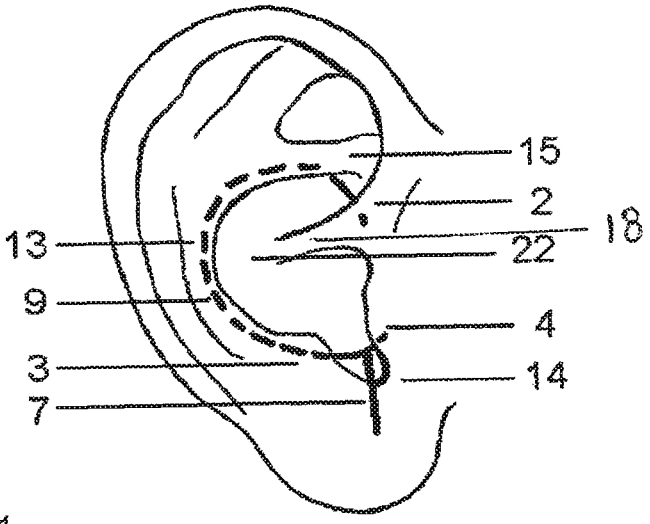
FIG. 1 shows schematically an ear with a curve along with a part extending down.

FIG. 1 shows schematically an ear with a decremental curve 1 inserted. As shown by the figure, the ear has an antihelix 13, a crus of helix 18, a tragus 4, an antitragus 3, an intertragic notch 14 and a concha 22 surrounded by the antihelix 13. The outer periphery of the ear unit is held in the ear by the outer parts of the ear such that the lower part of the antihelix 13, antitragus 3 and tragus 4 of the ear and part extending downwards 7, but intertragic notch 14. Parts of the curve is positioned inside the antihelix 13 when viewed from the outside of the ear where said parts therefore are not visible.

By the present invention, a larger part of the outer ear is utilized, thus achieving high stability while providing more comfort to the user than the previously known solutions. The present invention also utilizes the upper part of the antihelix 13 and the cavity covered by the lower node 15 of the antihelix and the flap 2 covering said cavity by the outer part of the ear adjacent to the head.

Figure 2:
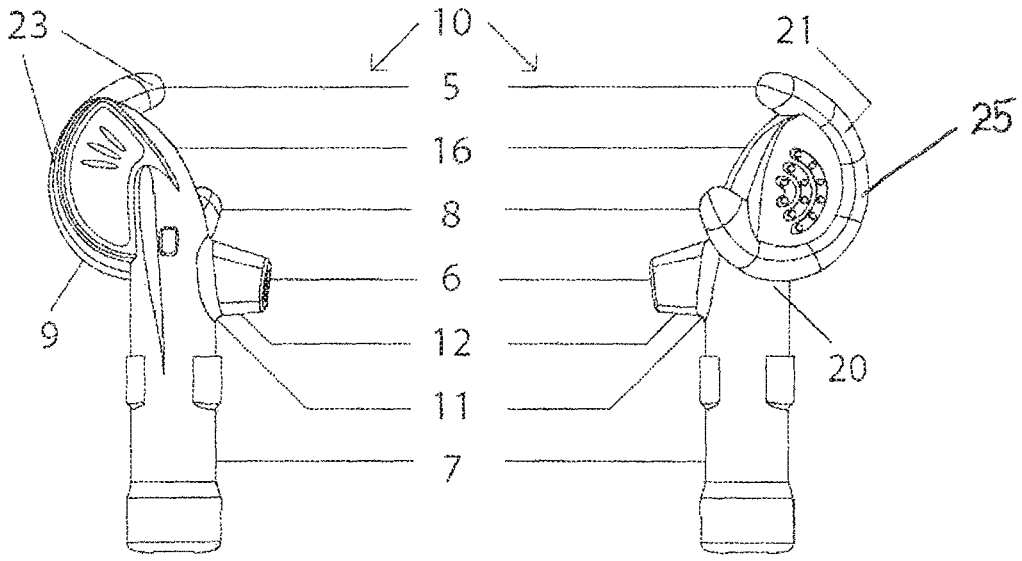
FIG. 2 shows an ear unit according to the present invention along with a microphone device.

The ear unit 10 according to the present invention is shown schematically in FIG. 2, with a microphone 6 and optionally a microphone rod 12 connected to the ear unit 10 at the junction point 11. Said microphone rod comprises the connection between the microphone 6 and the transmitter/receiver arranged in the ear unit 10. The power supply for the transmitter/receiver can optionally be arranged in the ear unit, for instance in the lower part 7 of the ear unit 10 for instance in the form of a rechargeable battery, for instance a miniature penlight cell that by virtue of its shape and weight leads to a low centre of gravity relative to the rotational axis formed at the landing point in a lower part of the ear cavity (by the intertragic notch 14). This helps increase the dynamic stability of ear unit 10 when the user is in motion. If the centre of gravity is too high and any centripetal forces caused by quick movements on the users behalf, it would cause the ear unit 10 to be pulled out of position from above. The antenna of the wireless part may be positioned for instance in the microphone rod. In addition, the ear unit 10 can be operated together with at least a second ear device to form a stereo effect.

Ear unit 10 comprises a decremental curve 9 of the outer part of the ear unit corresponding to the antihelix 13 with a surface shaped in such a way that the curve falls along the inner part of the antihelix 13 and is partly positioned under antitragus 3 of the ear. The optional lower part 7 extends from the curve while providing a guide and a weight for the correct positioning of the ear unit 10 by more or less lying in the intertragic notch 14 of the ear. The upper part of the curve projects into the cavity covered by the lower node 15 of the antihelix and underneath the flap 2 covering the lower part of said cavity. Investigations show that a contiguous line in the form of a decremental curve will fit in to the ear of nearly everyone.

By use of the ear unit 10, an opening is formed between the outer periphery 16 and the wall of the ear. This means that the ends 5 and 8 of the curve project out from the casing of the ear unit 10. Likewise, the part of the ear unit 10 comprising the hearing element is retracted slightly relative to the curve, ensuring that the hearing element does not abut the auditory canal directly, allowing the formation of an opening between the auditory canal and the surroundings.

The ear unit 10 is formed with a first surface 25 facing inwardly toward the concha 22 of the ear, a second, opposite surface 23 facing outwardly from the concha 22 of the ear, and an inner circumferential surface 26, opposite to the decremental curve 9 formed between the first surface 25 and the second surface 23. The first surface 25 has a curvature 21 in such a way that it follows along the inner surface of ear mussel or concha 22 when the ear unit 10 is positioned into the ear. This contact surface provides further stability since a larger area is placed against the ear mussel or concha, and thereby increased comfort.

The ear unit 10 is optionally arranged with an incision 20 so that it positions itself into the intertragic notch 14 when the ear unit 10 is positioned in the ear. This incision provides further stability and increased comfort.

FIG. 2 shows a typical embodiment of the invention with a part extending down 7 together with an incision 20 which ensures that said downward projecting part aligns with the intertragic notch 14 when the ear unit 10 is positioned into the ear.

Figure 3:
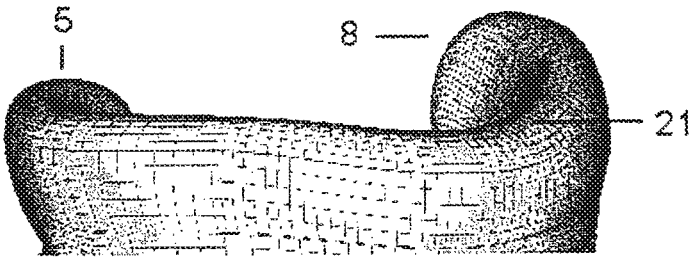
FIG. 3 shows an ear unit according to the present invention with a curvature enabling the ear unit to fit closely against the ear mussel.

FIG. 3 shows the ear piece 10 from the outside in such a way that the curvature 21 is clearly shown.

Figure 4:
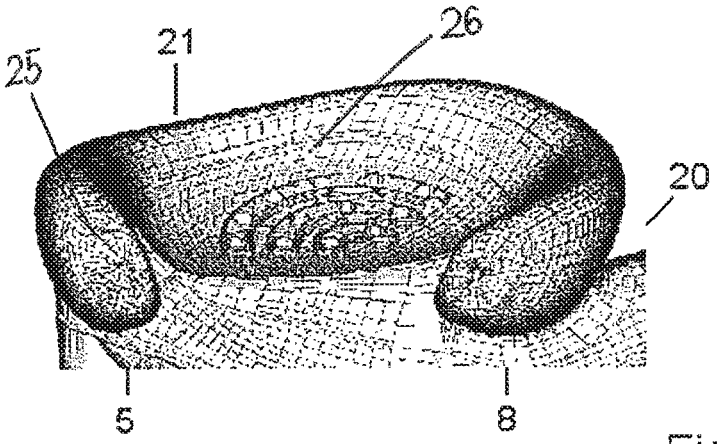
FIG. 4 shows the curvature of FIG. 3 from the opposite side and also an incision shaped in such a way that the incision is stabilized comfortably in the intertragic notch.
Figure 5:
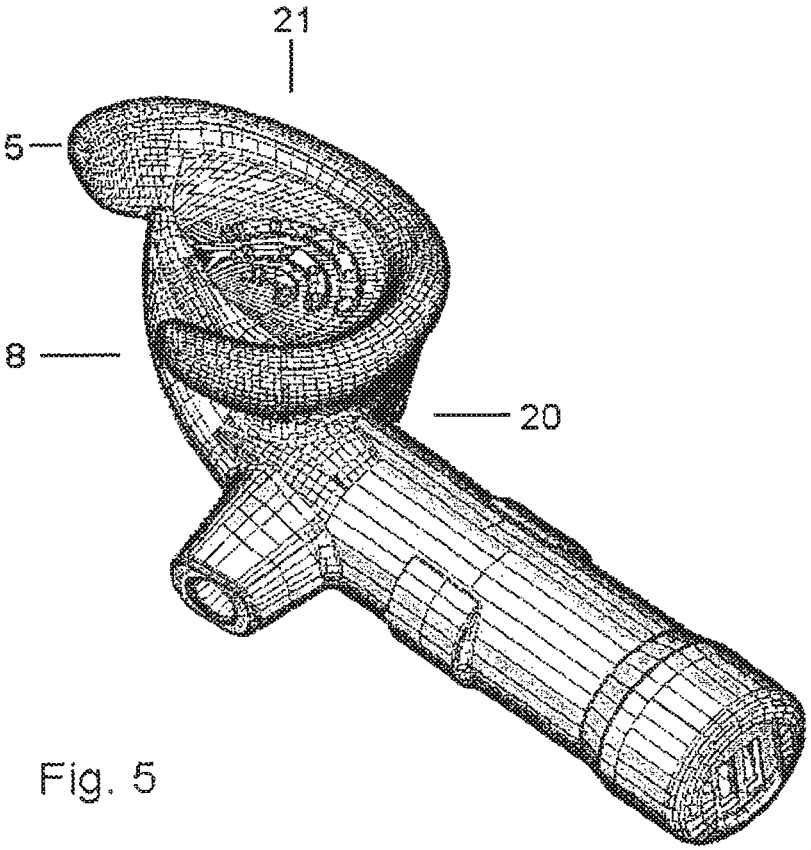
FIG. 5 shows an embodiment of the present invention comprising the curvature fitting closely against the ear mussel, the incision positioned stably into the intertragic notch and a part extending down from the ear unit.

FIGS. 4 and 5 show the ear piece from two different angles in such a way that the incision 20 is clearly shown.

What is claimed is:

1. A positioning and retaining structure for an earphone, the positioning and retaining structure comprising an outer edge and an inner edge, each extending from a base to be coupled to the earphone and meeting at a tip distant from the base, wherein the base comprises a cushion structure shaped to substantially fill the concha of a user when the earphone is worn in user's ear, the outer edge having differing radii of curvature along its length, including a first section at the base having a first radius of curvature and a second section near the tip having a second radius of curvature greater than the first radius of curvature, such that the outer edge is more sharply curved near the base and less-sharply curved near the tip.

2. The positioning and retaining structure of claim 1, further comprising:

projection at the tip that fits under the base of the user's helix when the earphone is worn.

3. A stability and comfort attachment structure for an earphone, comprising an outer edge and an inner edge, each extending from a base to be coupled to the earphone and meeting at a tip distant from the base, wherein a part of the base is shaped to substantially fill the concha of a user when the earphone is worn in user's ear, the outer edge having differing radii of curvature along its length, including a first section at the base having a first radius of curvature and a second section near the tip having a second radius of curvature greater than the first radius of curvature, such that the outer edge is more sharply curved near the base and less-sharply curved near the tip.

4. A ear unit for stable and comfortable attachment of an ear phone, comprising:

a first surface and a second surface, each extending from a base to be coupled to the earphone and meeting at an end distant from the base, wherein a part of the base is shaped to substantially fill in the concha of a user when the earphone is worn in user's ear, the first surface having differing radii of curvature along its length thereby forming a decremental curve, wherein the first surface is more-sharply curved near the base and less-sharply curved near the end distant from the base.

5. The ear unit of claim 4, further comprising:

projection at the end that fits under the base of the user's helix when the earphone is worn.

* * * * *